United States Patent [19]

Nishikawa et al.

[11] 4,230,786

[45] Oct. 28, 1980

[54] ELECTROGRAPHIC PROCESS OF IMAGING BY MODULATION OF IONS

[75] Inventors: Masaji Nishikawa; Toshio Nakatsubo, both of Hachioji; Hiroshi Tsuda, Mitaka; Shigo Fujie, Shizuoka; Masazi Kanamaru, Shizuoka; Shosaku Koseki, Shizouka, all of Japan

[73] Assignee: Olympus Optical Company Limited, Tokyo, Japan

[21] Appl. No.: 940,659

[22] Filed: Sep. 8, 1978

[30] Foreign Application Priority Data

Sep. 12, 1977 [JP] Japan ..... 52-108910

[51] Int. Cl.[2] ..... G03G 15/00

[52] U.S. Cl. ..... 430/53; 355/3 SC

[58] Field of Search ..... 96/1 R; 355/36 C; 430/53

[56] References Cited

U.S. PATENT DOCUMENTS

| | | | |
|---|---|---|---|
| 3,907,560 | 9/1975 | Sable | 355/3 SC |
| 3,937,571 | 2/1976 | Krulik et al. | 355/3 SC |
| 3,940,270 | 2/1976 | Krulik et al. | 355/3 SC |
| 3,964,827 | 6/1976 | Tanaka et al. | 355/3 SC |
| 4,026,700 | 5/1977 | Rasekhi | 355/3 SC |
| 4,099,863 | 7/1978 | Nakatsubo et al. | 355/3 SC |

*Primary Examiner*—Roland E. Martin, Jr.
*Assistant Examiner*—John L. Goodrow
*Attorney, Agent, or Firm*—Haseltine, Lake & Waters

[57] ABSTRACT

An electrographic process of producing, on a dielectric coated record medium, an electrostatic copy latent image by modulating a flow of corona ions with the aid of an electrostatic latent image which has been produced on a photoconductive photosensitive screen having a number of openings. The process is characterized by making a ratio K of a maximum surface potential V volts of the electrostatic copy latent image produced on the dielectric coated record medium to an intensity of the electric field E volts/mm established between the photoconductive photosensitive screen and the dielectric coated record medium, i.e. $K=V/E$ smaller than about 0.18 for the purpose of preventing enlargement of dots of the copy picture image.

6 Claims, 19 Drawing Figures

ELECTROGRAPHIC PROCESS OF IMAGING BY MODULATION OF IONS

BACKGROUND OF THE INVENTION

1. Field of the Invention

This invention relates to an electrographic process of producing, on a dielectric coated record medium, an electrostatic copy latent image by modulating a flow of corona ions with the aid of an electrostatic latent image which has been produced on a photoconductive photosensitive screen having a number of openings.

2. Description of the Prior Art

Various kinds of the above described electrographic processes have been well known. In such conventional electrographic process, the electrostatic copy latent image produced on the dielectric coated record medium is developed to obtain a copy picture image or the developed image is transferred to another record medium to obtain a copy picture image. The copy picture image thus obtained is decomposed into picture elements due to the openings of the photoconductive photosensitive screen. As a result, the conventional electrographic process has the drawbacks that the resolving power of the copy picture image becomes degraded, that the concentration of a thin line-shaped picture image becomes smaller than that of a thick line-shaped picture image, and that the contour of the peripheral portions of the picture image becomes unclear.

The above described drawbacks are caused by a phenomenon that the electric field established between the photoconductive photosensitive screen and the dielectric coated record medium is disturbed by the electrostatic copy latent image produced on the dielectric coated record sheet.

Experimental tests have demonstrated the result that the above mentioned phenomenon is associated with an intensity of the electric field established between the photoconductive photosensitive screen and the dielectric coated record medium, a maximum surface potential of the electrostatic copy latent image produced on the dielectric coated record medium, an electrostatic capacity of the dielectric coated record medium, etc.

SUMMARY OF THE INVENTION

An object of the invention, therefore, is to provide an electrographic process which can obtain a copy picture image excellent in concentration and picture quality by suitably selecting the above mentioned various conditions and combining them in a correct manner.

A feature of the invention is the provision of an electrographic process of producing, on a dielectric coated record medium, an electrostatic copy latent image by modulating a flow of corona ions with the aid of an electrostatic latent image which has been produced on a photoconductive photosensitive screen, characterized by making a ratio K of a maximum surface potential V volts of the electrostatic copy latent image produced on said dielectric coated record medium to an intensity of the electric field E volts/mm established between said photoconductive photosensitive screen and said dielectric coated record medium, i.e. $K=V/E$ smaller than about 0.18 for the purpose of preventing enlargement of dots of the copy picture image.

Another feature of the invention is the provision of an electrographic process wherein said dielectric coated record medium has an electrostatic capacity of larger than about 500 pF per 1 $cm^2$.

A further feature of the invention is the provision of an electrographic process wherein said intensity of the electric field E volts/mm established between said photoconductive photosensitive screen and said dielectric coated record medium is about 500 to 1,000 volts/mm.

A still further feature of the invention is the provision of an electrographic process wherein as said dielectric coated record medium use is made of an electrostatic record sheet composed of a substrate having upper and lower electrically conductive surfaces and a surface insulating layer coated on one side of said upper and lower electrically conductive surfaces, the other electrically conductive surface of said substrate having a surface specific resistance of about $2\times10^6$ to $2\times10^9$ Ω and said electrostatic record sheet having an electrostatic capacity of about 500 to 1,500 pF per 1 $cm^2$.

Another feature of the invention is the provision of an electrographic process wherein as said dielectric coated record medium use is made of an electrostatic record sheet composed of a substrate having upper and lower electrically conductive surfaces and a thickness of about 50 to 100 μ and a surface insulating layer coated on one side of said upper and lower electrically conductive surfaces and having a thickness of about 5 μ, said surface insulating layer containing a matting agent such as an insulating resin, metal oxide or the like, the other electrically conductive surface of said substrate having a surface specific resistance of about $2\times10^6$ to $2\times10^9$ Ω and said electrostatic record sheet having an electrostatic capacity of about 500 to 1,500 pF per 1 $cm^2$.

That is, in the present invention, the ratio K of a maximum surface potential V volts of the electrostatic copy latent image produced on the dielectric coated record medium to the intensity of the electric field E volts/mm established between the photoconductive photosensitive screen and the dielectric coated record medium, i.e. $K=V/E$ is made smaller than about 0.18.

DETAILED DESCRIPTION OF THE PREFERRED EMBODIMENTS

The invention will now be described in greater detail with reference to the accompanying drawings and experimental examples to be described later.

Figure 1:
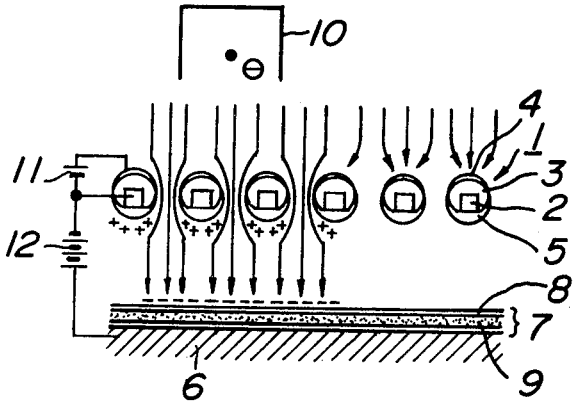
FIG. 1 is a schematic cross-sectional view illustrating a step of producing, on a dielectric coated record medium, an electrostatic copy latent image according to the invention.

FIG. 1 is a schematic cross-sectional view illustrating a step of producing, on a dielectric coated record medium, an electrostatic copy latent image according to the invention. In the present embodiment, a photoconductive photosensitive screen 1 is composed of an electrically conductive mesh 2 having 100 to 300 meshes, an insulating layer 3 coated on one side of the mesh 2, an electrically conductive layer 4 coated on the insulating layer 3, and a photoconductive layer 5 coated on the other side of the mesh 2. The photoconductive layer 5 of the photoconductive photosensitive screen 1 is uniformly charged with a positive polarity by means of a corona discharge device, then exposed to an optical image so as to produce thereon an electrostatic latent image corresponding to the optical image and subsequently a step of producing, on a dielectric coated record medium, an electrostatic copy latent image is effected.

In the step of producing, on the dielectric coated record medium, an electrostatic copy latent image shown in FIG. 1, a dielectric coated record medium 7 disposed on a field electrode 6 is opposed to and separated from the photoconductive layer 5 of the photoconductive photosensitive screen 1 bearing an electrostatic latent image. In the present embodiment, the dielectric coated record medium 7 is composed of an electrically conductive substrate 9, a dielectric layer 8 coated on one side of the substrate 9 and a field electrode 6 coated on the other side of the substrate 9. Above the electrically conductive layer 4 of the photoconductive photosensitive screen 1 is arranged a corona discharge device 10 which functions to direct a flow of corona ions having a polarity which is opposite to that of electric charge of the electrostatic latent image produced on the photoconductive layer 5 and which is a negative polarity in the present embodiment toward the electrically conductive layer 4. Between the electrically conductive mesh 2 of the photoconductive photosensitive screen 1 and the electrically conductive layer 4 is connected a screen bias source 11 and between the electrically conductive mesh 2 and the field electrode 6 is connected a field electrode bias source 12.

The bias voltage supplied from the screen bias source 11 functions to establish an electric field which prevents the flow of corona ions having the negative polarity and directed from the corona discharge device 10 from passing through openings of the photoconductive photosensitive screen 1 at its imagewise exposed area, that is, that part of the photoconductive layer 5 on which the latent image electric charge is absent. The bias voltage supplied from the field electrode bias source 12 functions to establish an electric field which causes the flow of corona ions directed from the corona discharge device 10 and having the negative polarity and passed through the openings of the photoconductive photosensitive screen 1 at the imagewise dark area thereof, that is, at that part of the photoconductive layer 5 at which the latent image electric charge is present to reach the dielectric coated record medium 7 without diffusing.

As a result, the flow of corona ions having the negative polarity and uniformly directed from the corona discharge device 10 is modulated by the electrostatic latent image which has been introduced on the photoconductive photosensitive screen 1 to produce, on the dielectric coated record medium 7, an electrostatic copy latent image corresponding to the electrostatic latent image on the photoconductive photosensitive screen 1 and composed of the electric charge having the negative polarity. The electrostatic copy latent image is made visible by a toner charged with a positive polarity, for example, and then subjected to a fixing step to provide a final copy picture image.

Figure 2:
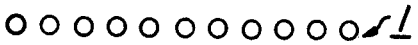
FIG. 2 is a schematic cross-sectional view illustrating a phenomenon of distorting the electric field of a field electrode by the electric charge on the dielectric coated record medium and of enlarging the dots of the electrostatic copy latent image.
Figure 2:
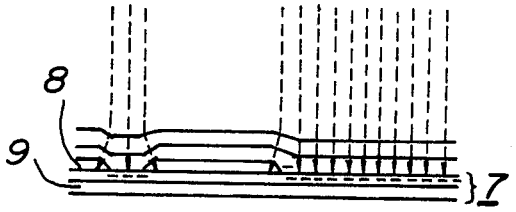

FIG. 2 is a schematic cross-sectional view illustrating a phenomenon of distorting the electric field of the field electrode by the electric charge on the dielectric coated record medium 7 in the step of producing, on the dielectric coated record medium 7, an electrostatic copy latent image and of enlarging the dots of the electrostatic copy latent image thus produced.

In FIG. 2, equipotential lines are shown by a full line located between the photoconductive photosensitive screen 1 and the dielectric coated record medium 7. These equipotential lines are rectilinear and not distorted when the electrostatic copy latent image is not produced on the dielectric coated record medium 7 or when the electrostatic copy latent image is produced on the dielectric coated record medium 7, but the potential thereof is low.

If the flow of corona ions passed through the openings of the photoconductive photosensitive screen 1 arrives at the dielectric coated record medium 7 and the potential of the electrostatic copy latent image is raised up in the negative direction, the potential at this portion becomes changed toward the potential of the photoconductive photosensitive screen 1. As a result, the equipotential lines are distorted toward the electrostatic copy latent image. This is because of the fact that the field electrode 6 is applied with a voltage having a polarity of directing the flow of corona ions for producing the electrostatic copy latent image toward the dielectric coated record medium 7, that is, a voltage having a positive polarity which is opposite to that of the flow of corona ions, and that the voltage is cancelled by the flow of corona ions arrived at the dielectric coated record medium 7.

In FIG. 2, electric lines of force are shown by dotted lines drawn perpendicular to the equipotential line. The flow of corona ions moves along the electric lines of force. As a result, if the equipotential line is distorted, the electric lines of force become also distorted and hence the flow of corona ions moves along the distorted electric lines of force.

This phenomenon occurs particularly at the edge portion of the electrostatic copy latent image to enlarge the dots at the edge portion, thereby inducing fading of the copy picture image.

In order to prevent the dots from enlarging due to distortion of the electric lines of force, it has been proposed to determine the field electrode bias voltage such that the intensity of the electric field of the field electrode is higher than 500 v/mm so as to restrict the corona charging width. Experimental tests under such condition have demonstrated the result that excellent copy picture images are not always obtained owing to the following reasons.

FIGS. 3*a*, 3*b*, 3*e* and 3*d* are enlarged schematic cross-sectional views illustrating mode of distorting the electric field of the field electrode by the electrostatic copy latent image. In this case, the intensity of the electric field of the field electrode is made 1,000 v/mm which is higher than the above mentioned 500 v/mm.

Figure 3A:
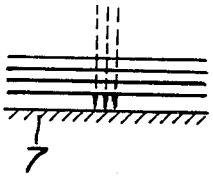
FIGS. 3*a*, 3*b*, 3*c* and 3*d* are enlarged schematic cross-sectional views illustrating modes of distorting the electric field of the field electrode by the electrostatic copy latent image.

As shown in FIG. 3*a*, if the electrostatic copy latent image is absent on the dielectric coated record medium 7, equipotential lines of 100 v equally spaced apart from each other by 0.1 mm extend in the direction from the dielectric coated record medium 7 toward the photoconductive photosensitive screen (not shown).

Figure 3B:
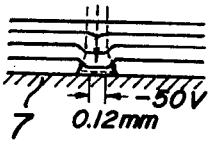

Let it be assumed that a flow of corona ions having a diameter of 0.12 mm is directed toward the dielectric coated record medium 7. At first, the flow of corona ions is directed as it is toward the dielectric record medium 7. If the flow of corona ions arrived at the dielectric coated record medium 7 causes the electrostatic copy latent image to obtain a potential of −50 v, an equipotential line of −100 v becomes distorted in a direction toward the electrostatic copy latent image, but it does not reach the surface of the dielectric coated record medium 7 as shown in FIG. 3*b*. In this case, respective equipotential lines of −200 v, −300 v . . . are also distorted, but the degree of distortion is gradually decreased in the order as mentioned above.

Figure 3C:
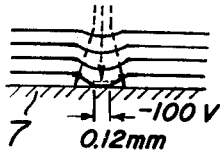

If the electrostatic copy latent image potential reaches −100 v, the equipotential line of −100 v completely passes through the surface of the dielectric coated record medium 7 and the degree of distortion of respective equipotential lines of −200 v, −300 v . . . becomes increased as shown in FIG. 3*c*.

Figure 3D:
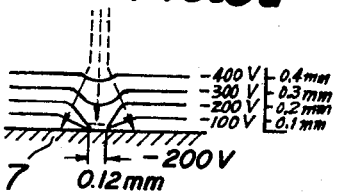

If the electrostatic copy latent image potential is further raised up to −200 v, the equipotential line of −200 v passes through the surface of the dielectric coated record medium 7 and the equipotential line of −100 v is penetrated into the dielectric coated record medium 7 through substantially outside the electrostatic copy latent image. It is a matter of course that respective equipotential lines of −300 v, −400 v . . . are further distorted as shown in FIG. 3*d*. As a result, the electric lines of force shown by dotted lines, that is, the flow of corona ions is further distorted, thereby considerably enlarging the dots.

In practice, the above described enlarging action of the dot is continuously increased by the arrival of the flow of corona ions, so that the dot has a peak point at its center and is gradually inclined toward its periphery so as to form a mountain-shaped dot.

This dot enlarging action is inversely proportional to the intensity of the electric field of the field electrode established between the photoconductive photosensitive screen and the dielectric coated record medium. That is, the higher the intensity of the electric field of the field electrode the lesser the dot enlarging action. In practice, use is made of the intensity of the electric field of the field electrode of about 500 to 1,000 v/mm, preferably about 800 v/mm.

If the intensity of the electric field of the field electrode exceeds 1,000 v/mm, it becomes near the dielectric breakdown voltage of air and there is a risk of the corona discharge or spark discharge being produced between the photoconductive photosensitive screen and the dielectric coated record medium.

As can be seen from the above description with reference to FIG. 3, the dot enlarging action is influenced by not only the intensity of the electric field of the field electrode but also by the maximum surface potential of the electrostatic copy latent image produced on the dielectric coated record medium.

As a result, it is not always possible to obtain satisfactory copy of the picture images under the above described conditions of the intensity of the electric field of the field electrode and corona charging width as proposed by the conventional electrographic process.

In addition, the action of the maximum surface potential of the electrostatic copy latent image produced on the dielectric record medium exerted on the electric field of the field electrode is somewhat charged by the field electrode bias voltage value. For example, let it be assumed that the intensity of the electric field of the field electrode is constant. If a distance between the field electrode 6 or the electrically conductive substrate 9 of the dielectric coated record medium 7 (FIG. 1) on the one hand and the photoconductive photosensitive screen 1 on the other hand is made short and the field electrode bias voltage value is made small, the amount of fading, that is, the dot enlarging action becomes somewhat increased, even when the electrostatic copy latent image potential is the same, if compare with the case when the above mentioned distance is long.

In the present invention, the maximum surface potential of the electrostatic copy latent image produced on the dielectric coated record medium is determined to a value lower than 100 v to 150 v and hence the field electrode bias voltage value becomes for higher than the electrostatic copy latent image potential, so that it is possible to disregard the dot enlarging action due to the higher or lower field electrode bias voltage value. As a result, it is conceivable that the dot enlarging action, that is, amount of fading the copy picture image is determined by a ratio of the maximum surface potential of the electrostatic copy latent image produced on the dielectric coated record medium to the intensity of the electric field established between the photoconductive photosensitive screen and the dielectric coated record medium.

The above described dot enlargement results in degradation of the resolving power of the copy picture image, of the concentration of the thin line-shaped copy picture image, of the contrast of the copy picture image, etc. and hence exerts an important influence upon the picture quality of the copy picture image. That is, if the dot is enlarged, that portion of the copy picture image at which lines of a letter, for example, are close with each other becomes deformed into a black point or thin line-shaped picture image becomes further thin and difficult to be discerned.

Figure 4A:
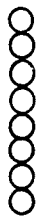
FIGS. 4*a*, 4*b*, 4*c* and 4*d* are schematic cross-sectional views of thin line-shaped and thick line-shaped copy picture images with dots of the electrostatic copy latent image enlarged and not enlarged.
Figure 4B:
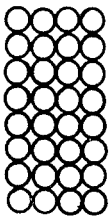

FIGS. 4*a* and 4*b* show thin line-shaped and thick line-shaped copy picture image obtained when the dot is not enlarged, respectively. In these cases, the picture images are formed of clear dots, respectively.

Figure 4C:
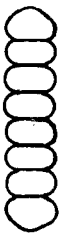
Figure 4D:
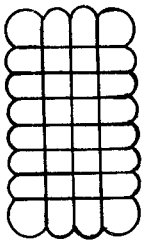

FIGS. 4*c* and 4*d* show thin line-shaped and thick line-shaped copy picture images obtained when the maximum surface potential of the electrostatic copy latent image produced on the dielectric record medium is increased so as to enlarge the dots, respectively. As described above with reference to FIGS. 2 and 3*a* to 3*d*, the dot is usually enlarged at the distorted part of the equipotential line and an extremely small distortion of the equipotential line occurs at the center part of the picture image having a relatively thick line and wide area, and hence the dot is not so much enlarged at such part. As a result, at the center part of the thick line-shaped picture image shown in FIG. 4*d*, the dots are enlarged and such enlarging action is ceased when the dots are brought closer together. But, at the periphery of the thick line-shaped image shown in FIG. 4*d* and the thin line-shaped image shown in FIG. 4*c*, the dots become enlarged in response to the increase of the maximum surface potential of the electrostatic copy latent image produced on the dielectric coated record medium. As a result, in the thin line-shaped image shown in FIG. 4*c*, the enlargement of the dots, that is, the dispersion enlargement of the electric charge results in a decrease of the density of the electric charge, and as a result, the thin line-shaped image shown in FIG. 4*c* becomes a faded line image which is lower in concentration than the thin line-shaped image shown in FIG. 4*a*. On the contrary, in the thick line-shaped image or wide area image shown in FIG. 4*d*, the dots are considerably enlarged at their periphery and brought closer together at their center, so that the electric charge density is not so much decreased. As a result, the picture image other than the periphery thereof becomes higher in concentration than the thick line-shaped image shown in FIG. 4*c*, but the picture image at the periphery becomes faded and lowered in concentration. In this way, the enlargement of the dots causes the quality of the copy picture image to considerably deteriorated, thereby rendering difficult to discern the copy picture image.

As described above, the enlargement of the dots is determined by the maximum surface potential of the electrostatic copy latent image produced on the dielectric coated record medium and the intensity of the electric field established between the photoconductive photosensitive screen and the dielectric coated record medium. As a result, let the maximum surface potential of the electrostatic copy latent image produced on the dielectric coated record medium be V volt and let the intensity of the electric field established between the photoconductive photosensitive screen and the dielectric coated record medium be E volt/mm, the amount of enlargement of the dots K is given by $K=V/E$.

It is preferable to make the value of K small. For this purpose, the intensity of the electric field of the field electrode E volts/mm must be made high. But, the intensity of the electric field of the field electrode E must be restricted as above described. In practice, the upper limit of the intensity of the electric field of the field electrode E is made 500 to 1,000 volt/mm and the maximum surface potential V volts of the electrostatic copying latent image produced on the dielectric coated record medium is made small.

The maximum surface potential V volts of the electrostatic copying latent image produced on the dielectric coated record medium is given by $V=Q/C$, where C is an electrostatic capacity of the dielectric coated record medium and Q is an amount of electric charge for producing the electrostatic copy latent image on the dielectric coated record medium. As a result, in order to make V small, it is necessary to make Q small or make C large. However, it is not desirous to make Q small in order to practically ensure the concentration of the picture image due to the development. In addition, the large and small amount of Q means the large and small amount by the flow of corona ions for producing the electrostatic copy latent image. As a result, in order to provide a high speed electrographic apparatus, it is impossible to make the value of C so much large. It is also conceivable to make C of the dielectric coated record medium large so as to increase the amount of the flow of corona ions. The use of such measures, however, is an obstacle to provide a high speed electrographic apparatus comprising a photoconductive photosensitive screen or a drum-shaped dielectric coated record medium.

Concerning the concentration of the copy picture image, in order to obtain the maximum concentration of the picture image by means of the same amount of electric charge Q, it is necessary to make C small so as to make the maximum surface potential V volts of the electrostatic copy latent image large. But, as described above, it is not desirous to make V large in association with the enlargement of dots and the intensity of the electric field of the field electrode E volts/mm.

The above described analysis of various points of view can be summarized as follows.

(1) In order to prevent the enlargement of dots, a value given by $K=V/E$ is made smaller than a certain value.

(2) The maximum surface potential V volts of the electrostatic copy latent image allowable for 500 to 1,000 volts/mm which is a value of the practically allowable intensity of the field electrode electric field E has its upper limit.

(3) In order to satisfy the condition required for the above mentioned maximum surface potential V volts of the electrostatic copy latent image and to ensure the practical development concentration, the amount of electric charge Q for producing the electrostatic copy latent image has its lower limit.

(4) In order to provide a high speed electrographic apparatus, the amount of electric charge Q for producing the electrostatic copy latent image has its upper limit.

In order to determine the above mentioned limit values, the inventors have effected experimental tests of producing copy picture images by using various kinds of electrostatic record sheets as the dielectric coated record medium. In the experimental tests, use was made of a drum-shaped photoconductive photosensitive screen having a diameter of 205 mm and required 3.64 seconds for its one rotation. The distance between the drum-shaped photoconductive photosensitive screen and the field electrode was 4.8 mm. The field electrode bias voltage was 4 kv. The electrostatic record sheet was fed at a speed of 160 mm/sec. The corona discharge device for directing the flow of corona ions for producing the electrostatic copy latent image had an area of directing the flow of corona ions of 40 mm×280 mm. The amount of corona electric current passing through the openings of the drum-shaped photoconductive photosensitive screen and directed toward the field electrode was 46 μA when the total surface of the picture image was dark. The apparatus had an ability of producing a copy picture image of 27.94 cm×43.18 cm (11 inch×17 inch) at a speed of 16.5 sheets/min. As a development system, use was made of a wet type development system.

The experimental tests on the copy picture image concentration effected by the above mentioned apparatus with the aid of the various kinds of electrostatic record sheets have demonstrated the result shown in the following Table 1.

TABLE 1

| Sample number | Electrostatic record sheet # | Electrostatic copy latent image potential | Picture quality | Copy picture image concentration |
|---|---|---|---|---|
| No. 1 | #1 | ◎280V | 1 | 1.08 |
| No. 2 | " | ○ 100V | 3 | 0.49 |
| No. 3 | #2 | ◎ 210V | 1 | 0.94 |
| No. 4 | " | ○ 100V | 3 | 0.53 |
| No. 5 | #3 | ◎ 210V | 2 | 1.0 |
| No. 6 | " | ○ 100V | 3 | 0.68 |
| No. 7 | #4 | ◎ 180V | 2 | 1.12 |
| No. 8 | " | ○ 100V | 3 | 0.85 |
| No. 9 | #5 | ◎ 170V | 3 | 1.07 |
| No. 10 | " | ○ 100V | 4 | 0.81 |
| No. 11 | #6 | ◎ 160V | 3 | 0.94 |
| No. 12 | " | ○ 100V | 5 | 0.71 |
| No. 13 | #7 | ◎ 150V | 2 | 0.72 |
| No. 14 | " | ○ 100V | 3 | 0.69 |
| No. 15 | #8 | ◎ 135V | 3 | 0.82 |
| No. 16 | " | ○ 100V | 3 | 0.72 |
| No. 17 | #9 | ◎ 115V | 3 | 0.91 |
| No. 18 | #10 | ◎ 110V | 5 | 0.94 |
| No. 19 | " | ○ 140V | 4 | 1.12 |
| No. 20 | #11 | ◎ 80V | 5 | 0.77 |
| No. 21 | " | ○ 140V | 4 | 0.88 |
| No. 22 | #12 | ◎ 80V | 4 | 0.65 |
| No. 23 | " | ○ 100V | 4 | 0.87 |
| No. 24 | #13 | ◎ 80V | 4 | 0.79 |
| No. 25 | " | ○ 100V | 4 | 0.93 |
| No. 26 | #14 | ◎ 60V | 5 | 0.72 |
| No. 27 | " | ○ 80V | 5 | 0.96 |

In the above Table 1, the electrostatic record sheet #1 to #14 include the conventional electrostatic record sheets and the electrostatic record sheets adapted to be used in the electrographic method according to the invention. Data designated by a symbol ◎ in the electrostatic copy latent image potential are obtained under the above mentioned condition of the standard amount of corona electric current. Data designated by a symbol ○ are obtained by intentionally changing the condition of the amount of corona electric current. The picture quality was judged by functional tests on the copy picture images obtained with respect to sharpness, resolving power, thin line-shaped picture image concentration or the like. Data 5 and 4 represent a practically good picture quality. 3 represents a picture quality which exhibits some drawback in the case of reproducing small Japanese letters or the like, but has no problem in the case of reproducing letters having usual size.

Figure 5:
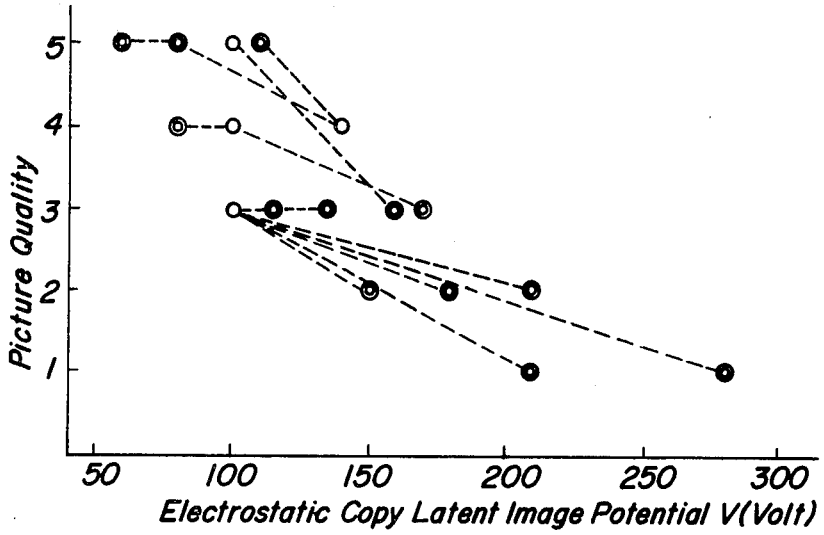
FIG. 5 is a graph showing the relation between an electrostatic copy latent image potential and a picture quality of a copy picture image.

FIG. 5 shows a graph illustrating the experimental test result listed in the Table 1 and showing the relation between the electrostatic copy latent image potential plotted on the abscissa and the picture quality plotted on the ordinate. In FIG. 5, the judgement of the picture quality and the meaning of the symbols ◎ and ○ are the same as those described with reference to the Table 1.

As can be seen from FIG. 5, if the intensity of the electric field E volts/mm established between the photoconductive photosensitive screen and the electrostatic record sheet is given by E=4 kv/4.8 mm=833 v/mm, the allowable electrostatic copy latent image potential V should be lower than about 150 volts. The picture quality becomes different depending on the kind of the electrostatic record sheet. Even though such picture quality difference is taken into consideration, the copy picture image having a good picture quality could not be obtained if the electrostatic copy latent image potential V is higher than 200 volts. In general, a good picture quality is obtained when the electrostatic copy latent image potential V is lower than 100 volts. In the case of an electrostatic record sheet considerably suitable for the electrographic process according to the invention, a good picture quality is occasionally obtained even when the above potential is about 150 volts.

Figure 6:
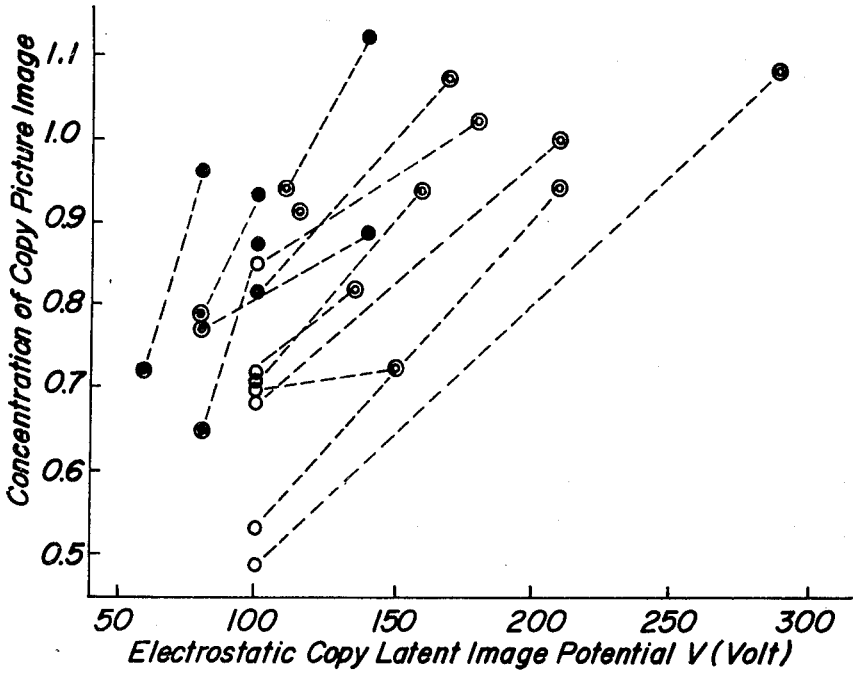
FIG. 6 is a graph showing the relation between an electrostatic copy latent image potential and a concentration of a copy picture image.

FIG. 6 is a graph showing the relation between the electrostatic copy latent image potential V plotted on the abscissa and the copy picture image concentration plotted on the ordinate. In FIG. 6, the meaning of the symbols ◎, ○ is the same as that described with reference to the Table 1. A symbol • designates a picture quality larger than 4 in the Table 1 and a symbol ○ designates a picture quality smaller than 3. As can be seen from FIG. 6, the copy picture image concentration in the standard amount of corona electric current (◎) tends to gradually increase at those electrostatic copy latent image potentials which are higher than about 150 volts, but tends to suddenly decrease at those electrostatic copy latent image potentials which are lower than about 150 volts. In the electrostatic copy latent image potential higher than 150 volts, if the amount of corona electric current is decreased to 100 volts, the copy picture image concentration becomes low and the copy picture image having bad picture quality only is obtained.

In the electrostatic record sheet which makes the electrostatic copy latent image potential low and makes the copy picture image concentration low under the standard corona electric current condition (Table 1, #10 to #14), if the amount of corona electric current is increased to increase the amount of charge, it is possible to obtain a copy picture image having a high concentration and good picture quality. As described with reference to FIG. 5, even in the above described case, it is desirous to make the copy picture image concentration sufficiently high within that range of the electrostatic copy latent image potential which is lower than 150 volts.

The electrostatic capacity of the electrostatic record sheet which can obtain the copy picture image having a high concentration and good picture quality will now roughly be estimated by taking the above mentioned facts into consideration. In the first place, the amount of charge Q per 1 $cm^2$ of the electrostatic record sheet is given by $$Q = \frac{I(\text{ampere}) \times t(\text{second})}{S(\text{cm}^2)} = \frac{46 \times 10^{-6} \times 3.64}{28 \times 20.5\pi} \ (\text{ampere} \cdot \text{second/cm}^2) \cong 0.93 \times 10^{-7} \ (\text{coulomb/cm}^2)$$

where I×t is a total amount of electric charge flowing during one rotation of the drum-shaped photoconductive photosensitive screen and S is an area of the electrostatic record sheet to be scanned during one rotation of the drum-shaped photoconductive photosensitive screen. The above amount of Q is obtained under the standard corona electric current condition. Under this condition, the electrostatic capacity C of the electrostatic record sheet for obtaining the electrostatic copy latent image potential of 200 volts is given by $$C = Q/V = \frac{0.93 \times 10^{-7}}{200} = 465 \times 10^{-12} F = 465\, pF$$

Similarly, if the electrostatic copy latent image potential is made 150 volts, the electrostatic capacity C of the electrostatic record sheet becomes 620 pF and if the electrostatic copy latent image potential is made 100 volts, the electrostatic capacity C of the electrostatic record sheet becomes 930 pF. As a result, the electrostatic capacity C of the electrostatic record sheet required for obtaining a copy picture image having a high concentration and good picture quality is about 500 to 1,500 pF/1 $cm^2$.

The electrostatic capacity of the electrostatic record sheet occasionally shows values different from each other depending on the method of applying the electric charge, charging time and the electric charge density.

In the electrographic process according to the invention, it is preferable to direct a flow of corona ions having a Q of $0.2\times10^{-7}$ to $5\times10^{-7}$ coulombs per 1 $cm^2$ of the electrostatic record sheet toward the drum-shaped photoconductive photosensitive screen for 0.05 to 0.5 second with the intensity of the electric field of 500 to 1,000 volts/mm established between the drum-shaped photoconductive photosensitive screen and the dielectric coated record medium.

The above described condition required for the electrostatic capacity of the electrostatic record sheet is similarly applicable to an intermediate transfer member used as the dielectric coated record medium. In this case, on the intermediate transfer member is produced the electrostatic copy latent image which is then developed into a toner image and this toner image is transferred onto a usual paper to obtain a copy picture image. The electrostatic capacity C of the intermediate transfer member is determined in association with the material of the dielectric layer and thickness thereof and given by $C=\epsilon_o\epsilon_s S/d$, where $\epsilon_o=8.854\times10^{-12}$ F/m, $\epsilon_s$ is a specific inductive capacity of the dielectric layer, S is an area of the dielectric layer and d is a thickness of the dielectric layer.

Now, the thickness d of the dielectric layer satisfying the above described electrostatic capacity condition and formed of synthetic resin is given by $$d = \epsilon_o\epsilon_s S/C = \frac{8.854 \times 10^{-12}\,(F/m) \times 3 \times 1(m^2)}{1 \times 10 \times 10^{-12}\,(F)} = \frac{2.66 \times 10^{-11}}{10^{-5}}\,(m) = 2.66\,(\mu)$$

where $\epsilon_s$ is usually 2 to 5, but is represented by 3 and C is 1,000 pF per 1 $cm^2$ and hence $1\times10^7$ pF per 1 $cm^2$.

Similarly, the thickness d of the dielectric layer having an electrostatic capacity C of 500 pF per 1 $cm^2$ is 5.32$\mu$.

If the dielectric layer is formed of a glass containing lead oxide and having a low melting point, its specific inductive capacity of the dielectric layer is about 20. In this case, the thickness d of the dielectric layer having an electrostatic capacity C of 1,000 pF/1 $cm^2$ is 17.7$\mu$ and the thickness d of the dielectric layer having an electrostatic capacity C of 500 pF/1 $cm^2$ is 35.5$\mu$.

If the dielectric layer is formed of aluminum oxide, its specific inductive capacity $\epsilon_s$ is 8.6 to 10.55 and can be represented by $\epsilon_s=10$. In this case, the thickness d of a dielectric layer having an electrostatic capacity C of 1,000 pF/1 $cm^2$ must be 9$\mu$ and the thickness d of a dielectric layer having an electrostatic capacity C of 500 pF/1 $cm^2$ must be 18$\mu$.

In the above described intermediate transfer member, the dielectric layer formed of synthetic resin may be formed by a spraying, dipping into resin solution, vapor phase polymerization process or the like. In this case, the synthetic resin layer is relatively thin in thickness, so that there is a risk of the synthetic resin layer being peeled off the electrically conductive substrate for each of adhering force therebetween. In order to eliminate such drawback, the synthetic resin layer is coated on another synthetic resin layer made electrically conductive by adding carbon powders, metal powders, etc.

When the dielectric layer is formed of glass having a high dielectric constant, such dielectric layer may be formed by dipping the substrate into a glass solution. The dielectric material for forming the dielectric layer by vacuum deposition method is $MgF_2$, ZnS, $CeO_2$, SiO, $SiO_2$, etc. Each of these materials may be formed into a dielectric layer having a thickness corresponding to each dielectric constant of these materials.

In the above described intermediate transfer member, the thickness of the dielectric layer having the electrostatic capacity of 1,000 pF/1 $cm^2$ to 500 pF/1 $cm^2$ has been calculated. The thickness of the dielectric layer having the electrostatic capacity of 700 pF/1 $cm^2$, which is intermediate between 1,000 pF/1 $cm^2$ and 500 pF/1 $cm^2$ and preferable in practice is 3.8$\mu$ when the specific inductive capacity $\epsilon_s=3$, 13$\mu$ when the specific inductive capacity $\epsilon_s=10$ and 26$\mu$ when the specific inductive capacity $\epsilon_s=20$.

The results investigated in detail as above described can be summarized as follows.

(1) The condition given by K=V/E should be smaller than 0.18 is determined by the conditions that the electrostatic copy latent image potential V allowable for the purpose of eliminating the fading in the copy picture image should be lower than about 150 volts and that the intensity of the electric field E of the field electrode is 4 kv/4.8 mm≃830 volts/mm.

(2) Under the above condition (1), in practice the intensity of the electric field of the field electrode E is determined to a value within a range between 500 volts/mm and 1,000 volts/mm.

(3) Under the above described condition required for the electrostatic copy latent image potential, the dielectric coated record medium is required to cause the copy picture image concentration to increase sufficiently high. For this purpose, as described with reference to FIG. 6, the amount of charge per 1 $cm^2$ of the electrostatic record sheet is required to be at least $0.2\times10^{-7}$ coulomb/$cm^2$, preferably at least $1\times10^{-7}$ coulomb/$cm^2$. In this case, the electrostatic copy latent image potential V should be lower than about 150 volts.

(4) It is preferable that the intensity of the electric field of the field electrode E is a value within a range between 700 volts/mm and 900 volts/mm and the electrostatic capacity of the dielectric coated record medium is at least 500 pF/1 $cm^2$. In the case of a high speed recording, use is made of a dielectric coated record medium having an electrostatic capacity of about 500 to 1,500 pF/1 $cm^2$ and the above mentioned K=V/E has a value of smaller than 0.18.

(5) The above described conditions (1) to (4) are effectively applicable to the electrographic process which makes use of the electrostatic record sheet as the dielectric coated record medium.

(6) The above described conditions (1) to (4) are effectively applicable to an electrographic process which makes use of an intermediate transfer member such as an intermediate transfer drum or belt, etc. which functions as a dielectric coated record medium for producing an electrostatic copy latent image thereon and in which the electrostatic copy latent image is developed into a toner image which is then transferred onto a usual paper.

(7) The electrostatic record sheet having an electrostatic capacity of 500 to 1,500 pF/1 $cm^2$ is effectively applicable to the electrographic process according to the invention.

(8) The intermediate transfer member having an electrostatic capacity of 500 to 1,500 pF/1 $cm^2$ is also effectively applicable to the electrographic process according to the invention.

(9) The intermediate transfer member described in the condition (8) is composed of an electrically conductive substrate and a film coated thereon and formed of synthetic resin, aluminum oxide, various kinds of inorganic dielectrics such as $MgF_2$, ZnS, $CeO_2$, SiO, $SiO_2$, etc. to be vapor deposited under vacuum, glass, ceramics, etc.

Figure 7:
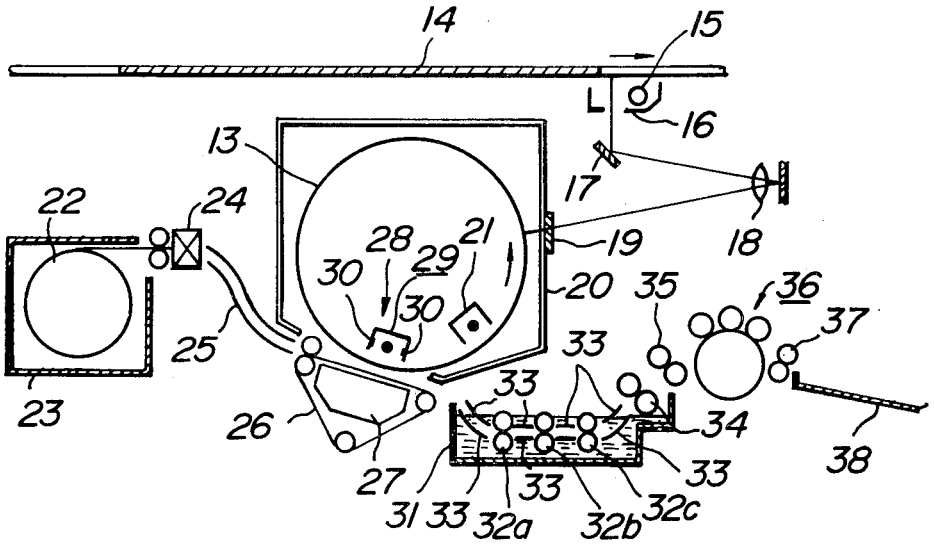
FIG. 7 is a schematic longitudinal sectional view of an electrographic apparatus for carrying out an electrographic process according to the invention.

FIG. 7 is a schematic cross-sectional view of one embodiment of the apparatus for carrying out the electrographic process according to the invention. In the present embodiment, use is made of a drum-shaped photoconductive photosensitive screen 13 having a diameter of 20.5 cm and effective recording width in the axial direction of 28 cm. The drum-shaped photoconductive photosensitive screen 13 is rotated in a direction shown by an arrow at a rate of one rotation per 3.64 seconds. A manuscript carriage 14 moves in a direction shown by an arrow in synchronism with the rotation of the drum-shaped photoconductive photosensitive screen 13. A manuscript (not shown) disposed on the manuscript carriage 14 is exposed to light emitted from an illumination lamp 15 and reflected by a light source mirror 16. A light reflected by the manuscript passes through an optical image mirror 17, projection lens 18 and light exposure window 19 and is incident on the drum-shaped photoconductive photosensitive screen 13. The light exposure window 19 is provided in a shield member 20 for surrounding the drum-shaped photoconductive photosensitive screen 13 except the window 19 and for preventing the screen 13 from adhering with dust, etc. The drum-shaped photoconductive photosensitive screen 13 is uniformly charged with a positive polarity by means of a first corona discharge device 21 arranged inside the drum and then exposed to an optical image, thereby producing thereon an electrostatic latent image corresponding to the optical image.

A roll-shaped electrostatic record sheet 22 is enlarged in a roll sheet cassette 23 and cut into a given length of segment by means of a cutter 24 in synchronism with the rotation of the drum-shaped photoconductive photosensitive screen 13. The electrostatic record sheet segment is fed through a paper guide 25 onto a vacuum suction conveyor belt 26. It should be noted that the electrostatic record sheet 22 must satisfy the above mentioned electrostatic capacity condition. The roll sheet cassette 23 functions to shield the electrostatic record sheet 22 from the open air so as to maintain its stabilized ability and prevent the front end of the record sheet from getting clogged. The vacuum suction conveyor belt 26 functions also as a field electrode and is arranged around a vacuum suction box 27 which functions to suck the electrostatic record sheet segment onto the vacuum suction conveyor belt 26. The distance between the vacuum suction conveyor belt 26 and the drum-shaped photoconductive photosensitive screen 13 is adjusted to 4.8 mm and between which is applied a bias voltage of 4 kv. A second corona discharge device 28 is arranged inside the drum-shaped photoconductive photosensitive screen 13 and located at a position opposed to the vacuum suction conveyor belt 26.

If the electrostatic record sheet segment arrives at the vacuum suction conveyor belt 26, the second corona discharge device 28 functions to direct a flow of corona ions toward the electrostatic record sheet 22. The flow of corona ions is modulated by the electrostatic latent image which has been produced on the drum-shaped photoconductive photosensitive screen 13 to produce, on the electrostatic record sheet 22, an electrostatic copy latent image corresponding to the electrostatic latent image which has been produced on the drum-shaped photoconductive photosensitive screen 13. To the corona discharge wire of the second corona discharge device is applied a high direct current voltage of 10 to 11 kv which is negative with respect to the drum-shaped photoconductive photosensitive screen 13 from a voltage source 39 shown in FIG. 8. A shield member 29 of the corona discharge device is provided at the inner periphery of its opening through which the flow of corona ions passes with an electrically conductive member 30 for controlling the width of the flow of corona ions. The electrically conductive member 30 is connected through a resistor 40 whose resistance value is 100 MΩ to the drum-shaped photoconductive photosensitive screen 13. The electrically conductive member 30 is held at −3 to −4 kv due to its self-biasing action and functions to prevent occurrence of spark between the corona discharge wire and the electrically conductive member 30. The amount of the corona electric current of the second corona discharge device 28 is determined such that about 46 μA of electric current flows from the second corona discharge device 28 through the drum-shaped photoconductive photosensitive screen 13 to the electrostatic record sheet corresponding to the picture image of totally black surface.

The electrostatic copy latent image produced on the electrostatic record sheet 22 is fed to a liquid developing device 31 and made visible by the latter. The liquid developing device 31 comprises three pairs of electrically conductive rollers **32*a*, 32*b*, 32*c* and four pairs of stationary developing electrodes 33 which also function as paper guides. The electrostatic record sheet whose electrostatic copy latent image has been developed into the visible image passes through a pair of squeeze rollers 34, a pair of suction rollers 35 and drying rollers 36 and becomes completely dried. The dry electrostatic record sheet then passes through a pair of delivery rollers 37 and is superimposed upon a tray 38**.

In the case of obtaining a plurality of copy picture images from one manuscript, the step of producing the electrostatic copy latent image only is carried out for desired number of times. In this case, it is possible to obtain 16.5 copy picture images of 27.94 × 43.18 cm (11 inch × 17 inch) every 1 minute. After a desired number of copy picture images have been obtained, the drum-shaped photoconductive photosensitive screen 13 is uniformly exposed to light, etc. in the rear of the first corona discharge device 21 viewed in the direction of rotation of the drum-shaped photoconductive photosensitive screen 13 shown by the arrow. As a result, it is possible to delete the electrostatic latent image remained on the screen 13, thereby completing the preparation of producing visible copies of the next manuscript.

The above described apparatus satisfies all of the conditions required for the electrographic process according to the invention and hence can obtain the copy picture images which are high in concentration and excellent in picture quality.

Figure 8:
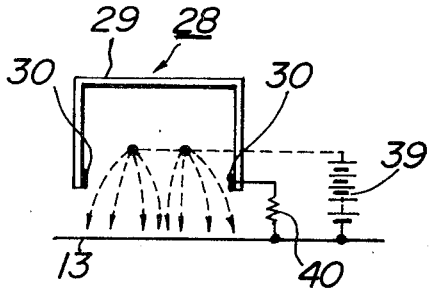
FIG. 8 is a schematic cross-sectional view of another construction of a second corona discharge device used in the electrographic apparatus shown in FIG. 7.

In the embodiment shown in FIG. 7, the second corona discharge device 28 is provided with one corona discharge wire. But, if the amount of the corona electric current must be increased in order to obtain copies at a high speed or to use an electrostatic record sheet having a high electrostatic capacity, provision may be made of two corona discharge wires as shown in FIG. 8. In this case, the amount of corona electric current becomes about 1.5 times larger than that of the corona discharge wire shown in FIG. 7. But, it is not preferable to provide a number of corona discharge wires as they considerably increase the corona charging width. If the copying speed is made low, the amount of electric charge given to the electrostatic record sheet is increased and hence use may be made of an electrostatic record sheet whose capacity is higher than 1,500 pF/1 $cm^2$.

Various conditions required for the electrographic process according to the invention have been described. The fundamental construction of the electrostatic record sheet for use in the electrographic process according to the invention which can satisfy the above mentioned conditions, which is stable against the change of the outside temperature and humid and which can be produced in a commercial scale will now be described.

FIGS. *9a*, *9b* and *9c* are cross-sectional views of conventional electrostatic record sheets, while FIG. *9d* is a cross-sectional view of one embodiment of an electrostatic record sheet for use in an electrographic process according to the invention. The conventional electrostatic record sheet 41 shown in FIG. *9a* is composed of an electrically conductive substrate 42 impregnated with a low resistance agent 43 and a surface insulating layer 44. The conventional electrostatic record sheet 41 shown in FIG. *4b* is composed of a substrate 42, a low resistance agent layer 43 coated on one side of the substrate 42 and a surface insulating layer 44 coated on the low resistance agent layer 23. The conventional electrostatic record sheet 41 shown in FIG. *9c* is composed of a substrate 42, two low resistance agent layers 43, 43 coated on both sides of the substrate 42, respectively, and a surface insulating layer 44 coated on one side of the two low resistance agent layers 43, 43.

The electrostatic record sheet 41 for use in the electrographic process according to the invention and shown in FIG. *9d* is composed of a substrate 42, two low resistance agent layers 43, 43 coated on both sides of the substrate 42, respectively, the low resistance agent 43 being partly impregnated into the substrate 42, so as to decrease the effective thickness of the substrate 42, and a surface insulating layer 44 coated on one side of the two low resistance agent layers 43, 43.

Even if the conventional electrostatic record sheet is applied to the electrographic process according to the invention, it is impossible to obtain a good picture image. It is conceivable that this is because of the fact that the principle and process of producing, on the conventional electrostatic record sheet, the electrostatic copy latent image are different from those of the electrographic process according to the invention.

For example, in a process of producing an electrostatic latent image by applying a pulse voltage to an array of pin electrodes in succession, a relatively large current is applied to a minute area for an extremely short time. The electric potential of the electrostatic latent image produced in this case is determined by the applied voltage, an electrical resistance against the transfer of electric charge toward the lower layer of the surface insulating layer, signal source impedance, tan $\delta$ characteristic of the material for forming the surface insulating layer, etc. on the one hand and by the electrostatic capacity of the surface insulating layer on the other hand. In addition, the electric potential of the electrostatic latent image is influenced by the roughness of the surface insulating layer and the configuration of the pin electrodes.

In the transfer of Electrostatic Latent Image (TESI) process in which an electrostatic record sheet is closely brought into contact with the electrostatic latent image produced on a photoconductor and the electrostatic latent image is transferred from the photoconductor to the electrostatic record sheet, the photoconductor and the electrostatic record sheet are spaced apart by a distance through which the electric charge can be transferred through an air layer sandwiched therebetween. As a result, the electric charge or the electrostatic latent image is transferred within an extremely short time. Similar to the above described process of using the pin electrodes, even in the TESI process, and electric charge having a reverse polarity and corresponding to the charge to be transferred to the surface insulating layer of the electrostatic record sheet must be supplied within a relatively short time. As a result, provision must be made of a semiconductive layer beneath the surface insulating layer. In the TESI process, the electrostatic capacity of the surface insulating layer is determined in the way such that the charge on the photoconductor is finally capacitively divided into a charge on the photoconductor and a charge on the surface insulating layer and that the discharge ceasing potential difference is present across these two members.

That is, the electrostatic capacity of the surface insulating layer is determined by such elements as the electrostatic capacity of the photoconductor, electric potential of the electrostatic latent image, electrostatic capacity of the electrostatic record sheet inclusive of the surface insulating layer, tan $\delta$ characteristic of the material for forming the surface insulating layer, resistance against the transfer of the electric charge of the substrate for constructing the electrostatic record sheet, etc.

In the above described electrographic process according to the invention, the electrostatic copy latent image is formed of dots one of which is supplied with substantially uniform charge for a long time of the order of several tens to several hundreds milliseconds. That is, the amount of charge supplied to the electrostatic copy latent image is determined entirely independently of that supplied to the electrostatic record sheet. The charge having the reverse polarity and corresponding to the charge (electrostatic copy latent image) on the surface insulating layer of the electrostatic record sheet can be supplied for a sufficiently long time. As a result, the tan $\delta$ characteristic of the surface insulating layer and the absolute value of the resistance of the lower layer of the surface insulating layer cause no trouble. In the electrostatic record sheet for use in the electrographic process according to the invention, therefore, the electrostatic capacity of the surface insulating layer or the composite electrostatic capacity of the surface insulating layer and of the substrate, becomes important.

Figure 9A:
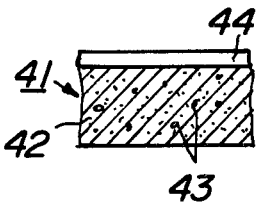
PRIOR ART FIG. 9a
FIGS. 9*a*, 9*b* and 9*c* are schematic cross-sectional views of conventional electrostatic record sheets, respectively.
Figure 9B:
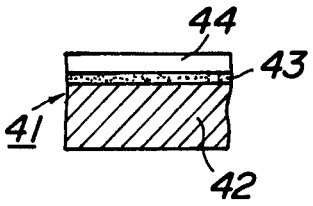
PRIOR ART FIG. 9b
Figure 9C:
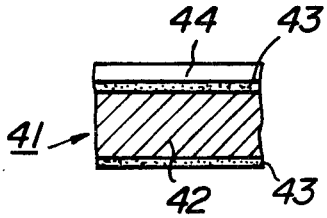
PRIOR ART FIG. 9c

But, in the conventional electrostatic record sheet 41 shown in FIGS. 9*a*, 9*b* and 9*c*, the surface insulating layer 44 is composed of an insulating resin material and a white pigment usually formed of metal oxide, etc. and added for the purpose of exhibiting a writing property, ink absorptivity, natural feeling, etc. The surface insulating layer 44 has a thickness which is generally of the order of 5μ order that the surface insulating layer 44 can hold the charge supplied when necessary, that the surface insulating layer 44 has a dielectric strength which can resist the applied voltage, and that the surface insulating layer 44 gives impression similar to the usual paper without inducing curling, etc. The electrostatic capacity of the surface insulating layer 44 only is considered to be 1,500 to 3,000 pF per 1 $cm^2$ owing to the fact that the dielectric constant of the above mentioned white pigment is generally high. As a result, such conventional electrostatic record sheet 41 could not be used for obtaining copies at a high speed. On the contrary, the substrate 42 has generally a thickness of 60 to 100μ and a considerably small electrostatic capacity.

As described above, the electrostatic record sheet for use in the electrographic process according to the invention has an electrostatic capacity of at least 500 pF per 1 $cm^2$, preferably 500 to 1,500 pF per 1 $cm^2$. As a result, the conventional electrostatic record sheet 41 shown in FIG. 9*a* whose electrostatic capacity is determined by the surface insulating layer 44 could not be used for the electrographic process according to the invention.

Experimental tests have demonstrated the result that a copy picture image obtained by the conventional electrostatic record sheet 41 constructed as shown in FIG. 9*b* could not be used in practice. In addition, the conventional electrostatic record sheet 41 constructed as shown in FIG. 9*c* could not be used for the electrographic process according to the invention since even though the surface insulating layer 44 only has a large electrostatic capacity, the electrostatic capacity of the record sheet 41 as a whole is remarkably small.

Figure 9D:
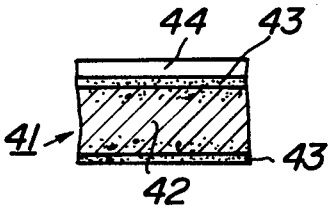
FIG. 9*d* is a schematic cross-sectional view of an electrostatic record sheet used for an electrographic process according to the invention.
Figure 10:
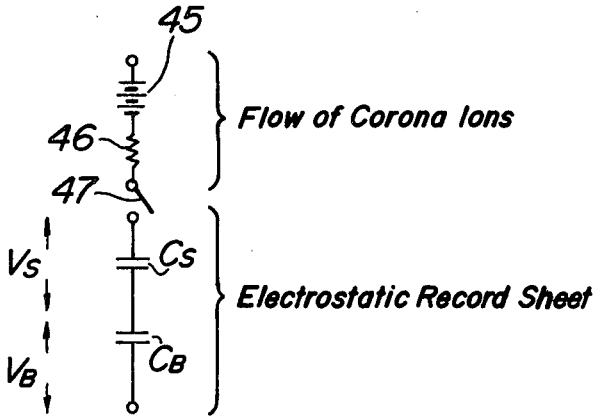
FIG. 10 is an equivalent circuit used in the case of producing, on the electrostatic record sheets shown in FIGS. 9*c* and 9*d*, respectively, an electrostatic copy latent image.

FIG. 10 shows an equivalent circuit of the conventional electrostatic record sheet 41 constructed as shown in FIG. 9*c* and also of the electrostatic record sheet 41 constructed as shown in FIG. 9*d* according to the invention. In the equivalent circuit shown in FIG. 10, the flow of corona ions directed from the photoconductive photosensitive screen is a constant current source represented by an electric source 45 and a resistor 46 connected in series.

The electrostatic record sheet is represented by a series circuit consisting of a capacity $C_S$ of the surface insulating layer and an electrostatic capacity $C_B$ of the substrate. This series circuit is connected to the above mentioned constant current source by means of a switch 47. In the electrographic process according to the invention, the electrostatic record sheet is charged for a relatively long time, so that it is possible to omit a resistor component from the electrostatic record sheet. In the equivalent circuit shown in FIG. 10, the electrostatic copy latent image potential produced on the electrostatic record sheet is a charging voltage $V_S+V_B$ across two terminals of the series connected $C_S$ and $C_B$.

In the conventional electrostatic record sheet 41 constructed as shown in FIG. 9*c*, $C_B$ is considerably smaller than $C_S$, so that its composite electrostatic capacity C is given by $$C = \frac{C_B C_S}{C_B + C_S} \cong \frac{C_B C_S}{C_S} C_B$$

That is, the composite electrostatic capacity C is substantially determined by the electrostatic capacity $C_B$ of the substrate 42.

Let the specific inductive capacity $\epsilon_s$ be 3, then the composite electrostatic capacity C per 1 $cm^2$ is given by $$C = \epsilon_0 \epsilon_s S/d = \frac{8.854 \times 10^{-12}\,(F/m) \times 3 \times 1 \times 10^{-4}\,(m^2)}{60 \times 10^{-6}\,(m)}$$
$$\cong 0.44 \times 10^{-10}\,(F) = 44(pF)$$

This composite electrostatic capacity C per 1 $cm^2$ is considerably smaller than the electrostatic capacity of the electrostatic record sheet for use in the electrographic process according to the invention, i.e. 500 to 1,500 pF per 1 $cm^2$.

On the contrary, in the electrostatic record sheet 41 for use in the electrographic process according to the invention and shown in FIG. 9*d*, the low resistance agent 43 coated on the both side surfaces of the substrate sheet 42 are partly impregnated into the substrate 41 so as to decrease the effective thickness of the substrate 41. As a result, the composite electrostatic capacity C consisting of the electrostatic capacity $C_S$ of the surface insulating layer 44 and the electrostatic capacity $C_B$ of the substrate sheet 42 connected in series becomes increased. The composite electrostatic capacity C can easily be changed without adjusting the thickness and composition of the surface insulating layer 44.

That is, the composite electrostatic capacity C can easily be changed by adjusting the degree of impregnation of the low resistance agent 43 into the substrate 42. Thus, the electrostatic record sheet 41 shown in FIG. 9*d* is far advantageous in manufacture if compared with the conventional electrostatic record sheets 41 shown in FIGS. 9*a*, 9*b*, 9*c*. A practical example of an electrostatic record sheet for use in an electrographic process according to the invention and shown in FIG. 9*d* will now be described.

EXAMPLE

Pulp composed of 60 parts of NBKP and 40 parts of LBKP was adjusted to a degree of heating of 60° SR. The pulp thus adjusted was added with clay to obtain a sheet having a thickness of about 80μ. The sheet was passed through 12 stages calender roll to prepare a substrate having a density of 0.95, size degree of 12 seconds and thickness of about 56μ.

The low resistance agent was prepared by adding 5 parts of methyl alcohol to 100 parts of low resistance solution mainly consisting of polyvinyl benzine trimethyl ammonium chloride and mixed at various ratios with polyvinyl alcohol as a resistance adjusting material. The methyl alcohol was added for the purpose of penetrating the low resistance solution into the substrate. Addition of too much amount of the methyl alcohol causes the low resistance solution to penetrate into the entire part of the substrate sheet. Several low resistance agents were coated on both side surfaces of the substrate with amounts variable from about 4 $g/m^2$ to provide several kinds of low resistance substrates. On one side surface of each of such low resistance substrates was coated a surface insulating layer consisting of the following compositions

| | |
|---|---|
| Butyral | 65 parts |
| Styrene resin | 5 parts |
| Calcium carbonate | 20 parts |
| Titanium oxide | 10 parts |

and having a dry weight of about 6 g/m$^2$ (thickness of about 5$\mu$) to provide several kinds of electrostatic record sheets. On 16 electrostatic record sheets prepared as above described were produced respective electrostatic copy latent images by means of the apparatus for carrying out the electrographic process according to the invention and then these latent images were developed to obtain the copy picture image. The electrostatic copy latent image potential, picture image concentration and picture quality of the copy picture image thus obtained are shown in the following Table 2.

TABLE 2(a)

| Electrostatic Record Sheet No. | Surface Specific Resistance of Substrate (Ω) Back Surface Layer | Intermediate Layer | Electrostatic Capacity (pF/1 cm$^2$) Substrate | Whole | Electrostatic Copy Latent Image Potential (volt) | Copy Picture Image Concentration | Picture Quality |
|---|---|---|---|---|---|---|---|
| 1 | $1.9 \times 10^6$ | $1.9 \times 10^6$ | about 2,000 | 1,000 | 85 | 0.65 | 5 |
| 2 | " | $1.6 \times 10^7$ | about 2,000 | — | — | 0.75 | 5 |
| 3 | " | $1.3 \times 10^8$ | about 1,900 | — | — | 0.70 | 5 |
| 4 | " | $1.8 \times 10^9$ | about 1,800 | — | — | 0.80 | 5 |
| 5 | $1.6 \times 10^7$ | $1.9 \times 10^6$ | about 1,500 | 850 | 100 | 0.85 | 5 |
| 6 | " | $1.6 \times 10^7$ | about 1,500 | — | — | 0.80 | 5 |
| 7 | " | $1.3 \times 10^8$ | about 1,400 | — | — | 0.85 | 5 |
| 8 | " | $1.8 \times 10^9$ | about 1,300 | — | — | 0.90 | 4 |

TABLE 2(b)

| Electrostatic Record Sheet No. | Surface Specific Resistance of Substrate (Ω) Back surface Layer | Intermediate Layer | Electrostatic Capacity (pF/1 cm$^2$) Substrate | Whole | Electrostatic Copy Latent Image Potential (volt) | Copy Picture Image Concentration | Picture Quality |
|---|---|---|---|---|---|---|---|
| 9 | $1.4 \times 10^8$ | $1.9 \times 10^6$ | about 1,000 | 650 | 130 | 0.95 | 4 |
| 10 | " | $1.6 \times 10^7$ | about 1,000 | — | — | 0.95 | 4 |
| 11 | " | $1.3 \times 10^8$ | about 900 | 500 | 170 | 1.15 | 2 |
| 12 | " | $1.8 \times 10^9$ | about 800 | — | — | 1.10 | 3 |
| 13 | $2.0 \times 10^9$ | $1.9 \times 10^6$ | about 500 | 400 | 210 | 1.25 | 1 |
| 14 | " | $1.6 \times 10^7$ | about 500 | — | — | 1.30 | 1 |
| 15 | " | $1.3 \times 10^8$ | about 500 | — | — | 1.20 | 1 |
| 16 | " | $1.8 \times 10^9$ | about 400 | — | — | 1.25 | 1 |

In the above Table 2, the surface specific resistance and electrostatic capacity of each substrate were measured in the above mentioned step of manufacturing the electrostatic record sheet. The surface specific resistance of the substrate was measured after adjusting humidity for 1 hour at 20° C. in atmosphere of 65% RH by applying a voltage of 100 V with the aid of "Room Temperature Measuring Box D-601" and "Ultra Insulation Meta-30" made by Kawaguchi Denki K.K. in Japan. The electrostatic capacity of the substrate was measured with the aid of a high voltage Schering bridge. The electrostatic capacity of each electrostatic record sheet as a whole was calculated on the basis of the electrostatic copy latent image potential and amount of flow of corona ions at the time of producing, on each electrostatic record sheet, the electrostatic copy latent image by the apparatus shown in FIG. 7. The picture quality of the copy picture image was evaluated with the same standard as that of the Table 1 with respect to the reproduction of the minute parts of the copy picture image.

As can be seen from the Table 2, the electrostatic capacity of the substrate becomes increased as the surface specific resistance thereof is decreased and particularly becomes considerably changed by the resistance value of the back surface layer which is opposed to the surface insulating layer. In addition, the electrostatic capacity of the electrostatic record sheet as a whole tends to increase in response to increase of the electrostatic capacity of the substrate and becomes saturated to a limit value of the electrostatic capacity of the surface insulating layer. Strictly speaking, the depth of impregnation, etc. of the low resistance agent is considered to be an element other than the surface specific resistance. But, the above described measuring method can obtain the result inclusive of such element. As a result, the evaluation of manufacture, management, etc. can be effected by the above mentioned value in practice. It is not fully elucidated that the electric potential applied in the case of development is $V_S$ or $V_S+V_B$ shown in FIG. 10. But, in the Table 2, the electrostatic copy latent image potential corresponding to the electrostatic capacity of the electrostatic record sheet as a whole corresponds to the copy picture image concentration in a relatively good manner. As a result, it is proper to consider that the electric potential $V_S+V_B$ from the back surface of the electrostatic record sheet acts in substantially effective manner.

As can be seen from the above Table 2, a good copy picture image is obtained when the electrostatic capacity of the electrostatic record sheet as a whole is larger than 650 pF per 1 cm$^2$. In addition, the electrostatic capacity of the electrostatic record sheet as a whole should not be smaller than 500 pF per 1 cm$^2$ even if the selection of the surface insulating layer material, change of the substrate sheet composition, etc. are taken into consideration as already described with reference to the Table 1 and FIGS. 5 and 6.

As described above, in order to ensure the practical copying speed, the electrostatic capacity of the electrostatic record sheet should be smaller than 1,500 pF per 1 $cm^2$. The electrostatic record sheet for satisfying such condition can easily be obtained by constructing it as shown in FIG. 9*d* and listed in the Table 2.

In order to obtain the above described desired electrostatic capacity of the electrostatic record sheet, the degree of low resistance treatment of the substrate is substantially determined by the surface specific resistance of the back surface layer of the substrate listed in the Table 2. That is, the desired electrostatic capacity of the electrostatic record sheet can be obtained by determining the surface specific resistance of the back surface layer of the substrate sheet to the order of about $2\times10^6\,\Omega$ to $1.4\times10^8\,\Omega$. Even if the thickness or material of the surface insulating layer is changed, it is possible to provide an electrostatic record sheet which can satisfy the above mentioned range of the electrostatic capacity by selecting the above mentioned surface specific resistance to the order of about $2\times10^6\,\Omega$ to $2\times10^9\,\Omega$.

As stated hereinbefore, the electrostatic record sheet adapted to be effectively used for the electrographic process according to the invention is composed of a substrate made electrically conductive and having a thickness of 50 to 100$\mu$, a surface insulating layer coated on one side surface of the substrate and having a thickness of about 5$\mu$, the surface insulating layer being formed of an insulating resin mixed with or without an inorganic oxide, etc., the electrostatic capacity as calculated from the amount of flow of corona ions received through a photoconductive photosensitive screen and from charging potential being 500 to 1,500 pF per 1 $cm^2$ and the surface specific resistance of the other side surface of the base sheet being $2\times10^6\,\Omega$ to $2\times10^9\,\Omega$. The electrostatic record sheet thus constructed can obtain the copy picture images which are extremely excellent in resolving power, thin line contrast, concentration and picture quality.

As stated hereinbefore, experimental tests have demonstrated the result that the dots of the electrostatic copy latent image produced on the dielectric coated record medium become enlarged in dependence with the relation between the intensity of the electric field of the field electrode E and the maximum surface potential V of the electrostatic copy latent image and that if $K=V/E$ is made smaller than 0.18, it is possible to effectively prevent the dots from enlarging. As a result, if the above condition is satisfied, it is possible to effectively prevent the degradation of the resolving power of the copy picture image, decrease of the concentration of the thin line-shaped picture image and fading, etc., thereby obtaining the copy picture images which are high in concentration and good in picture quality. In addition, experimental tests have yielded the result that if the electrostatic capacity of the dielectric coated record medium for use in the electrographic process according to the invention is at least 500 pF per 1 $cm^2$, preferably be 500 to 1,500 pF per 1 $cm^2$, then it is possible to effectively satisfy the above mentioned condition that $K=V/E$ is smaller than 0.18. As a result, if use is made of the dielectric coated record medium which can satisfy the condition required for the electrostatic capacity, it is possible to obtain the copy picture images which are extremely excellent in concentration and picture quality. In addition, a high speed copying apparatus may be realized in an extremely efficient manner.

The invention is not limited to the above described embodiments, but various alternations and modifications are possible. For example, in the above described example and the apparatus shown in FIG. 7, the electrostatic copy latent image produced on the electrostatic record sheet has been developed into a visible image by the humid type developing system. Instead of such humid type developing system, use may be made of well known dry type developing system, developing system in which thermoplastic resin is heated, etc. In addition, instead of the drum-shaped photoconductive photosensitive screen, use may be made of sheet-shaped or belt-shaped photoconductive photosensitive screen. The photoconductive photosensitive screen may be modified such that the photoconductive layer may be coated so as to cover the electrically conductive member or the photoconductive layer and the insulating layer may be coated so as to expose a part of the electrically conductive member.

What is claimed is:

1. An electrographic process of producing, on a dielectric coated record medium, an electrostatic copy latent image by modulating a flow of corona ions with the aid of an electrostatic latent image which has been produced on a photoconductive photosensitive screen, characterized by making a ratio K of a maximum surface potential V volts of the electrostatic copy latent image produced on said dielectric coated record medium to an intensity of the electric field E volts/mm established between said photoconductive photosensitive screen and said dielectric coated record medium, i.e. $K=V/E$ smaller than about 0.18 for the purpose of preventing enlargement of dots of the copy picture image, said intensity of the electric field E established between said photoconductive photosensitive screen and said dielectric coated record medium being about 500 to 1,000 volts/mm.

2. The process according to claim 1, wherein the electrostatic copy latent image produced on the dielectric coated record medium is developed by a liquid development and said dielectric coated record medium has an electrostatic capacity larger than about 500 F per 1 $cm^2$.

3. The process according to claim 2, wherein as said dielectric coated record medium use is made of an electrostatic record sheet composed of a substrate having upper and lower electrically conductive surfaces and a surface insulating layer coated on one side of said upper and lower electrically conductive surfaces, the other electrically conductive surface of said substrate having a surface specific resistance of about $2\times10^6\,\Omega$ to $2\times10^9\,\Omega$ and said electrostatic record sheet having an electrostatic capacity of about 500 to 1,500 pF per 1 $cm^2$.

4. The process according to claim 3, wherein said electrostatic record sheet has a thickness of about 50 to 100$\mu$ and contains a matting agent.

5. The process according to claim 4 wherein said matting agent is an insulating resin or a metal oxide.

6. The process according to claim 1 wherein the dielectric coated record medium has an electrostatic capacity between about 500 and 1500 pF per $cm^2$.

* * * * *